US005813837A

United States Patent [19]

Yamamoto et al.

[11] Patent Number: 5,813,837

[45] **Date of Patent: *Sep. 29, 1998**

[54] AXIAL-FLOW IMPELLER FOR MIXING LIQUIDS

[75] Inventors: Masafumi Yamamoto, Kakogawa; Yukimichi Okamoto, Kobe, both of Japan

[73] Assignee: Shinko Pantec Kabushiki Kaisha, Hyogo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 732,890

[22] Filed: Oct. 17, 1996

[30] Foreign Application Priority Data

Nov. 1, 1995 [JP] Japan ..... 7-285066
Aug. 12, 1996 [JP] Japan ..... 8-212448

[51] Int. Cl.[6] ..... F04D 29/38

[52] U.S. Cl. ..... 416/223 R; 416/237; 416/DIG. 5; 366/270; 366/330.3; 366/330.5

[58] Field of Search ..... 416/223 R, 231 A, 416/235, 236 R, 236 A, 237, 238, 243, DIG. 2, DIG. 5; 366/370, 330.1, 330.3, 330.5; 440/49

[56] References Cited

U.S. PATENT DOCUMENTS 4,222,710 9/1980 Katagiri et al. ..... 416/236 A
4,468,130 8/1984 Weetman .
4,569,131 2/1986 Gray, III ..... 416/238
5,052,892 10/1991 Fasano .

FOREIGN PATENT DOCUMENTS 0 284 929 10/1988 European Pat. Off. .
0 469 302 2/1992 European Pat. Off. .
37 30 423 3/1989 Germany .
1454277 11/1976 United Kingdom .

OTHER PUBLICATIONS

S. Winardi and Y. Nagase, "Unstable Phenomenon of Flow in a Mixing Vessel With A Marine Propeller", *Journal of Chemical Engineering of Japan;* vol. 24, No. 2, pp. 243–249 (Apr. 1991).

*Primary Examiner*—Christopher Verdier
*Attorney, Agent, or Firm*—Marshall, O'Toole, Gerstein, Murray & Borun

[57] ABSTRACT

An axial-flow impeller having a maximum blade width less than 20% of the impeller diameter, the pitch angle at the radial position 0.6 is 12°–22°, the width at the tip end portion of the blade is 12–75% of the width at the radial position 0.6, the pitch angle at the tip end portion of the blade is 5°–10° smaller than the pitch angle at the radial position 0.6, the width at the root of the blade is 40% or more of the width at the radial position 0.6, and the pitch angle at the root of the blade is 25°–50°. An axial-flow impeller having a maximum width of the blade 20% or more of the impeller diameter, the radial position of the maximum width portion is 0.4–0.8, the pitch angle of the maximum width portion is 12°–22°, the width at the tip end portion of the blade is 12–75% of the maximum width, and the pitch angle at the tip end portion of the blade is 5°–10° smaller than the pitch angle at the maximum width portion, the width at the root of the blade is 40–100% of the maximum width, and the pitch angle at the root of the blade is 25°–50°.

2 Claims, 15 Drawing Sheets

WIDTH AT THE TIP END PORTION OF THE BLADE($d_2$)
/THE MAXIMUM BLADE WIDTH($W_O$)

FIG. 13A
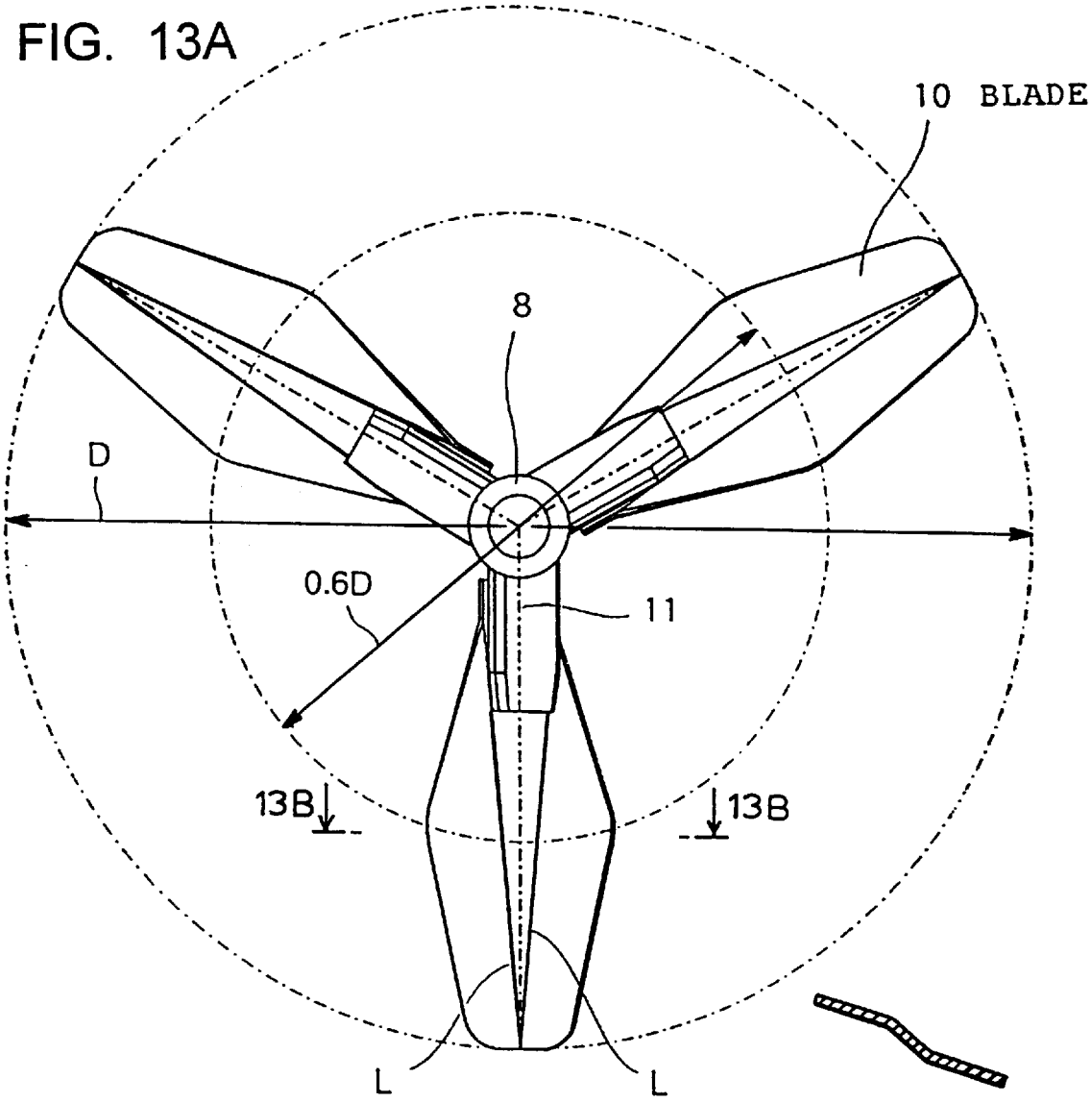
FIG. 13B
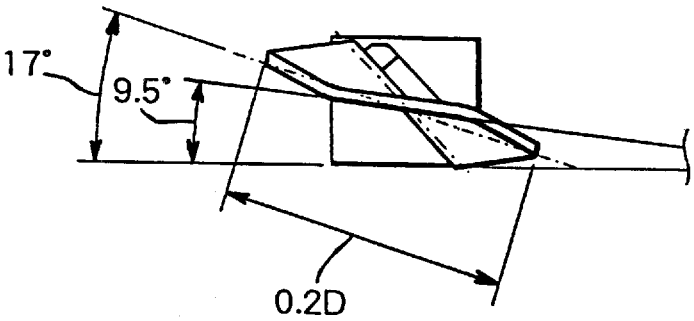
FIG. 14

AXIAL-FLOW IMPELLER FOR MIXING LIQUIDS

The invention relates to a mixing impeller causing an axial flow, and more specifically, to a mixing impeller used in storage tanks for blending of low or medium viscosity liquids, and droplet or particle dispersion in low or medium viscosity liquids.

BACKGROUND OF THE INVENTION

Mixing impellers which can discharge the fluid in the direction of the impeller shaft (hereinafter called "axial-flow impellers") are often used for mixing fluids such as blending of low and medium viscosity liquids and droplet or particle dispersion in low and medium viscosity liquids.

This type of impeller can provide a higher discharge flow rate at smaller torque and with less energy consumption than other impellers, and therefore is economically advantageous in terms of equipment cost and operating cost.

With this type of impeller, pitched paddle impellers and propellers are generally used. Pitched paddle impellers can be manufactured most easily and at the lowest cost, but compared to propellers, they require larger torque and more energy to obtain the same flow rate, that is, their discharge efficiency is poor. It is also known that pitched paddle impellers produce an intermediate flow pattern between the axial and the radial ones depending on the pitch angle.

If impeller blades are made in such a manner to vary their thickness from the leading edge to the trailing edge according to an aero-foil profile, like marine propeller blades, a high discharge efficiency might be achieved. However, in turn, the manufacturing cost becomes extremely high. Alternatively, there has been employed, a manufacturing method to bend impeller blades of uniform thickness to a curved surface with its pitch height kept constant in the radial direction by the use of a die. There has been advocated a method, to increase the ratio of lift to drag, where the blades are twisted so that the flow angle of attack is kept constant at each radial position on the blades. To further increase the ratio of lift to drag, impeller blades are provided with a suitable camber in the sections from their leading edges to the trailing edges. Since these propellers are fundamentally manufactured using dies, it is necessary to fabricate different dies for different sizes of impellers. When impellers are small and can be mass-produced, they can be economically manufactured even by this method, but it is extremely expensive to fabricate dies for each order of large-size impellers.

Various types of axial-flow impellers described as follows are known.

That is, U.S. Pat. No. 5,052,892 discloses a technique for imparting camber effect by bending the blade 21 of the pitched paddle impeller along the center line in the radial direction as shown in FIG. 19 to improve the discharge efficiency as well as to improve mechanical strength of the blade. In said patent, it is described that the blades should preferably be a plate of uniform width and should preferably have a mean pitch angle of 25°~30°, and the folds should preferably be two folds intersecting at the tip end of the blade, and a total of fold angles should preferably be 20°~30° (hereinafter called the "conventional impeller A").

In U.S. Pat. No. 4,468,130, as shown in FIG. 20, it is disclosed that the maximum discharge efficiency can be achieved by adjusting the camber and pitch angle from the tip end of the blade 22 to the root to the threshold value where flow separation is about to happen, and specific examples to vary the camber from 8% of blade width at the tip end to 0% at the root and the pitch angle from 22° at the tip end to 38° at the root are described. The blade width is about ⅛ of the impeller diameter and is slightly narrower at the tip end side and slightly wider at the root side. According to this patent, this impeller is described to be less expensive than propellers but simultaneous forming by bending and twisting where the curvature continuously changes is required and it is assumed that different dies are required for each size of impeller in order to achieve precise fabrication (hereinafter called the "conventional impeller B").

In addition, German Patent Application No. 3730423, as shown in FIG. 21, tries to improve the discharge efficiency by attaching an auxiliary blade 24 parallel to a main blade 23 in the axial direction. As adding an auxiliary blade in this way increases torque and energy consumption as well, an increment of flow rate more than enough to make the increase of torque and energy consumption is assumed to be achieved with the impeller of FIG. 21. However, because the main blade is of a simple pitched paddle as shown in FIG. 21, it would be difficult to achieve the efficiency equivalent to that of propellers even if its discharge efficiency is improved (hereinafter called the "conventional impeller C").

Furthermore, British Patent No. 1,454,277 discloses that properly cutting of a cylinder surface can produce a blade with the camber, 5~15% of blade width and with its pitch height nearly constant in the radial direction (hereinafter called the "conventional impeller D").

What is required for axial-flow impellers for agitators is, in short, to suppress the equipment cost and operating cost and achieve specified agitation purposes. In particular, in blending of a low viscosity liquid or dispersion of solid particles, agitator performance is frequently defined by the discharge flow rate or the product of flow velocity and discharge flow rate, and an axial-flow impeller which can be fabricated at low cost and high discharge efficiency is required.

According to the study of Nagase and Winardi (Journal of Chemical Engineering of Japan; Vol. 24, NO. 2, pp. 243–249 (1991), when marine propellers are used in agitating tanks, the flow is unstable as in the case of turbine or pitched paddle impellers, and it has been recognized that the circumferential flow velocity fluctuates to twice its value even at the discharge stream near the impeller. The magnitude of turbulence is as large as 20~50%. Therefore, the fact that the inflow and outflow to and from the impeller intermittently vary not only raise questions whether such a propeller design method of keeping the flow angle of attack constant can really improve the discharge efficiency of mixing impellers, but also would suggest similar reviews on design methods of axial-flow impellers, where aero- or hydro-foil theories are applied to improve their performance. This is because the flow which foil (wing) theories treat is a streamlined uniform flow and this greatly differs from the flow in agitating tanks.

The key points in the performance design of axial-flow impellers including propellers lie in how the blade width, pitch angle, and camber should be distributed in the radial direction to achieve a maximum discharge efficiency. The most reliable technique is to vary each of these characteristics, and measure the discharge efficiency to optimize the characteristics. However, there are few reports on this kind of research.

Therefore, the present inventors used the same agitating tank and mounted each of the above mixing impellers (conventional impellers A~D, a pitched paddle impeller, and a propeller) to the same position, and measured the discharge flow rate at the same water volume, same rotating speed, same torque, and same energy consumption. Impeller torque, rotating speed, and discharge flow rate were measured with a strain gauge torque meter, an electromagnetic tachometer and a laser Doppler velocimeter, respectively. Two types of pitched paddle impellers were used, one was a 45°—pitched four blade paddle impeller, the other was a 30°—pitched three blade paddle impeller. The propeller used had its pitch height equal to the impeller diameter with uniform blade thickness and with no camber on the blades. Under the above-mentioned measuring conditions, it is possible to compare impellers under the condition of basically the same equipment cost, excluding the impeller of the agitator, and the same operating cost. Cases in which two types of impellers are compared under the conditions of the same energy consumption but at different torques and rotating speeds are seen in literature, but such comparison is not suited for evaluating economical performance. For instance, a greater discharge flow rate can be obtained at the same energy consumption when the impeller diameter is increased in the same type of impeller. However, the increased diameter makes the impeller torque much larger and the equipment cost of the agitator increases, thus it is unable to carry out a fair comparison from an economical viewpoint only by bringing the energy consumption to the same level.

The results of comparing the discharge flow rate of each mixing impeller by the above-mentioned inventor's method indicate that the discharge flow rate decreases in order of the propeller, conventional impeller A, conventional impeller B, 30°—pitched paddle impeller, conventional impeller D, conventional impeller C, and 45°—pitched paddle impeller, and the difference of discharge flow rate between adjacent impellers in ranking was 8~11% of the discharge flow rate of the propeller when conventional impellers A and are excluded from the ranking. That is, publicly known conventional axial-flow impellers have their discharge flow rate less than that of the above propeller which can be comparatively easily designed and fabricated in existing propellers. When still more flow rate is required, the impeller diameter or rotating speed must be increased to operate at large torque and large energy consumption. As a result, even if the impeller's fabrication cost can be reduced compared to the conventional impellers, the equipment cost and operating cost of the agitator increases, thereby canceling the economical advantages.

On the other hand, even a propeller with uniform thickness blade and no camber needs dies for fabricating at high precision. Moreover, if the size of impellers varies, different dies must be fabricated and this is expensive. Not only propellers but also impellers which require a twist in the blade, for example, conventional impeller B, need different dies for each size of impellers.

It is noteworthy that in the above-mentioned mixing impellers, the conventional impeller A achieved the discharge flow rate next to the propeller, with its simple shape of rectangular blades bent at two places. As compared to this, conventional impeller B and D applied with foil theory concepts, and conventional impeller C utilizing interference effects of a cascade of blades achieved discharge flow rates less than that of conventional impeller A, in spite of their complicated shapes as compared to conventional impeller A. This may be attributed to the application of two-dimensional foil (wing) theory to three-dimensional rotators and possibly to the difference of conditions that the flow in the agitating tank is circulated flow in a closed space and the turbulence is extremely high, and the stream flowing into the blade greatly differs from the uniform defined stream which is handled by the foil (wing) theory.

To summarize the above-mentioned investigation results, an economical axial-flow impeller shall be such that comprises blades of uniform thickness, which are formed with a twist-free simple curved surface or a plane bent at several places, and provides the discharge efficiency equivalent to or greater than that of propellers.

SUMMARY OF THE INVENTION

The object of the present invention is to provide such an axial-flow impeller, that is, an economical axial-flow impeller with a compact shape and discharge efficiency equivalent to or greater than that of propellers.

In order to solve the above-mentioned problems and to obtain an axial-flow impeller with satisfactory discharge efficiency, its blade shape and dimensions of every portion are optimized through experiments, where a series of impeller models are made by stepwisely varying the blade shape and each of the dimensions, then the impeller torque, energy consumption and discharge flow rate are actually measured, in an agitating tank to determine the optimum combination of shape and dimensions. In a preliminary experiment, a variety of axial-flow impellers were made; they were different in pitch angle, blade width, with and without twist and/or camber; each of them was set at a given position in an agitating tank with its diameter, D=400 mm, and height, H=500 mm, and with four baffle plates of 40 mm width, equally spaced on the cylindrical tank wall, as shown in FIG. 1, to measure and compare its discharge flow rate under the same conditions of water value 58.6 liters, rotating speed, 300 rpm, impeller torque, 0.43 Nm, and energy consumption, 0.013 kW. The results of this preliminary experiment indicated that: the influence of pitch angle is the greatest; the influence of twist is also important, which corresponds to the change of pitch angle in the radial direction; the influence of camber is not clear; excessively wide impellers apparently reduce the discharge flow rate but in some range, the change in the discharge flow rate is small; and varying the blade width in the radial direction varies the discharge flow rate. For the measuring method of the discharge flow rate, all the impellers were rotated in the downward discharge direction, the downward flow velocities of the lower surface of the blade were measured 5 mm below the lower edge of the blade at 10 mm intervals in the radial direction by using a laser Doppler velocimeter, and the measured velocities were integrated to provide the discharge flow rate. The value at each measuring point was obtained by averaging 20,000 pieces of data.

Then, with respect to (1) the maximum blade width; (2) radial position and pitch angle of the maximum width portion; (3) width and pitch angle at the tip end portion of the blade; and (4) width and pitch angle at the root of the blade, the axial-flow impellers were fabricated with these specifications varied stepwisely, and the discharge flow rate was measured using the same method as in the above-mentioned preliminary experiment. As a result, it has been able to confirm that fabricating the axial-flow impellers of the following shape and size can achieve the discharge efficiency equivalent to and greater than that of the propeller. To define the meanings of the terms used in this specification: "the radial position" means that with the impeller shaft center designated to 0 and the blade tip end to 1, the position in the radial direction is exponentially indicated; "the width of the blade" means the linear distance from the leading edge in the rotating direction to the trailing edge at the same radial position; and "the pitch angle" means the angle formed by the straight line defining the width and a plane perpendicular to the shaft.

BRIEF DESCRIPTION OF THE DRAWINGS

FIG. 13 (*a*) shows a plan view of an axial-flow impeller according to a second embodiment and FIG. 13 (*b*) shows a section view on section S—S of FIG. 13 (*a*);

FIG. 14 shows an enlarged side view of the blade of the axial-flow impeller of FIG. 13 (*a*);

DETAILED DESCRIPTION OF THE INVENTION

Referring now to FIG. 2–7, the technique for determining the specifications or characteristics of the shape of a blade of an axial-flow impeller according to this invention will be described, but the same drawings also show the discharge flow rate of each test impeller by an exponent with the discharge flow rate of the conventional impeller B designated to 100.

(1) Maximum blade width

Figure 2:
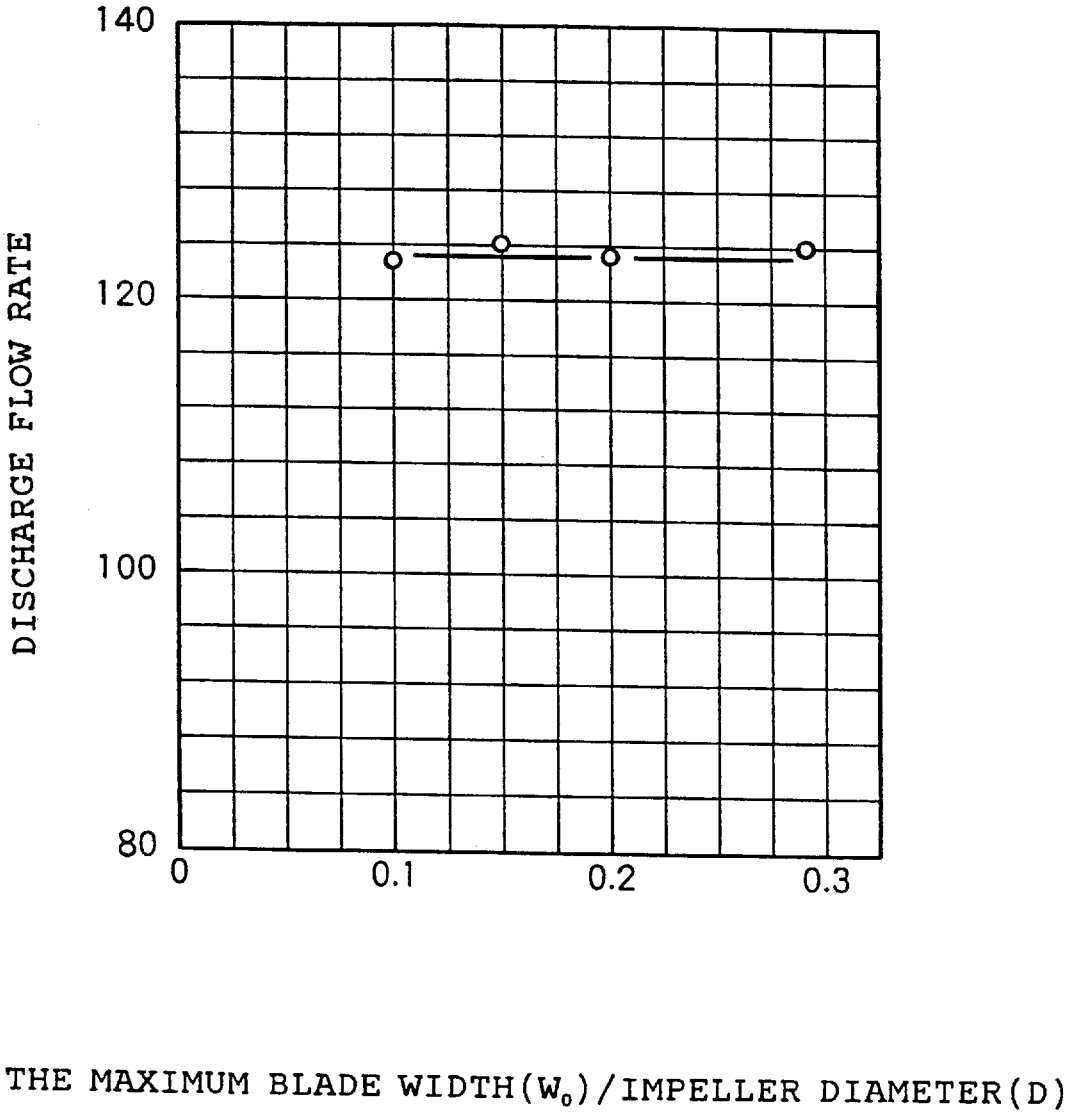
FIG. 2 shows the relationship between the discharge flow rate and the ratio of the maximum blade width to impeller diameter.
Figure 8:
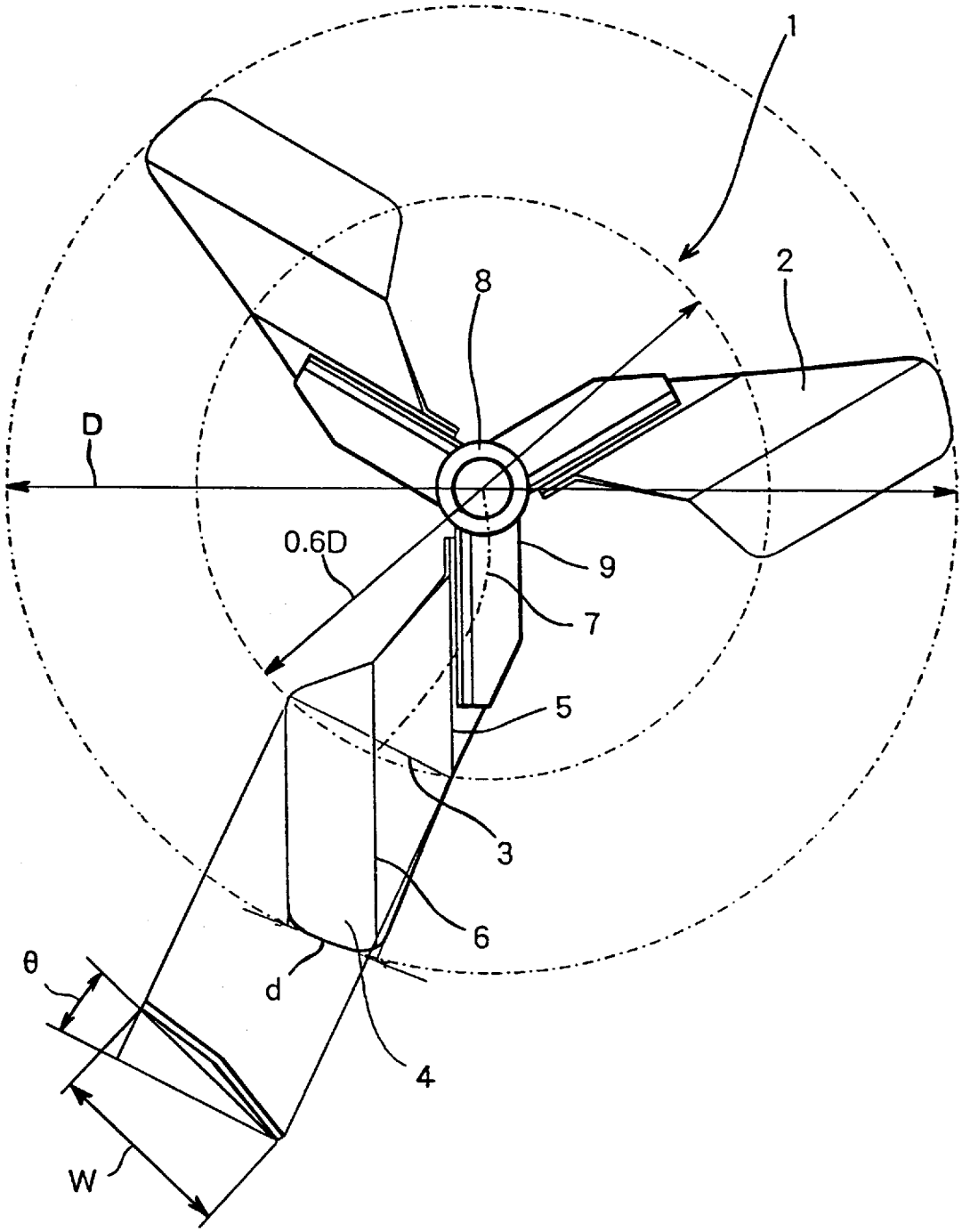
FIG. 8 shows a plan view of an axial-flow impeller according to a first embodiment.

FIG. 2 shows the relationship between the discharge flow rate and the ratio of the maximum blade width ($W_0$: see FIG. 8) to the impeller diameter (D: see FIG. 8). In this case, the radial position of the maximum width portion of the blade is 0.7 and the pitch angle of the maximum width portion is 20°, the width at the tip end portion of the blade is about 50% of the maximum width, the pitch angle at the tip end portion of the blade is 13°–16°, the width at the root of the blade is about 60% of the maximum width, and the pitch angle at the root of the blade is 40°.

As shown in FIG. 2, when the maximum blade width ($W_0$) is within the range from 10 to 30% of the impeller diameter (D), the discharge flow rate scarcely varies and indicates a large value, but the maximum blade width is an important element that influences the discharge flow rate, and the design philosophy of the blade shape should be changed for slim blades with the small maximum width (maximum width <20% of the impeller diameter) from that of the blades with comparatively large maximum width (maximum width ≧20% of the impeller diameter). This is because with the blade with a slim shape, the maximum width does not constitute large fluid resistance, and whether the maximum width portion is located at the tip end portion of the blade or on the root, it is assumed that it would not have any large effect on the discharge flow rate, but when the maximum width of the blade becomes comparatively large (maximum width ≧20% of impeller diameter), the radial position of the maximum width portion will have a large influence on the discharge flow rate as will be described later.

(2) Radial position of the maximum width portion of the blade

Figure 3:
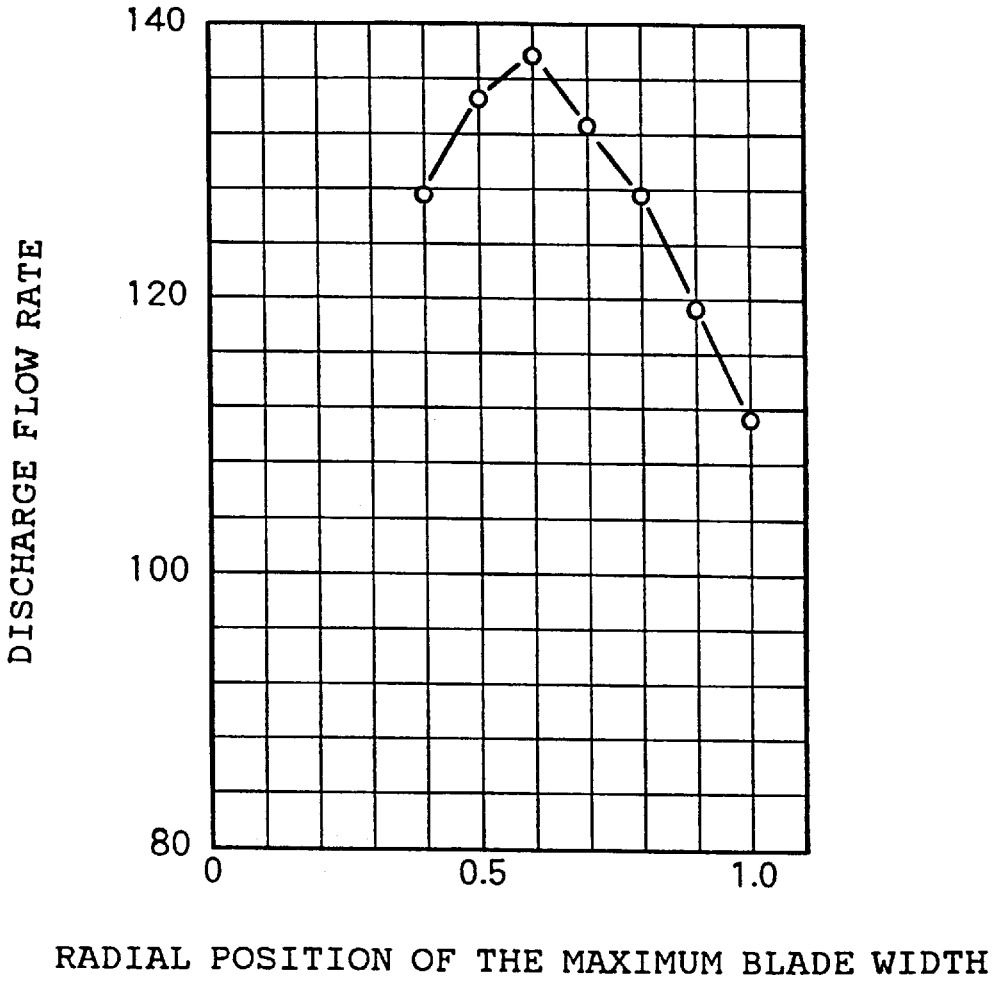
FIG. 3 shows the relationship between the discharge flow rate and the radial position of the maximum blade width.

FIG. 3 shows the relationship between the maximum width portion of the blade and the discharge flow rate. In this case, the maximum blade width is 20% of the impeller diameter, the pitch angle of the maximum width portion is 17°, the width at the tip end portion of the blade is about 50% of the maximum width (however, when the radial position of the maximum width portion is 1.0, the width at the tip end portion coincides with the maximum width), the pitch angle at the tip end portion of the blade is 11°–17°, the width at the root of the blade is about 50% of the maximum width, and the pitch angle at the root of the blade is 40°.

As the maximum width of the blade increases (maximum width ≧20% of the impeller diameter), the radial position of the maximum width portion is important in terms of the relationship with the discharge flow rate. That is, if the maximum width portion is located on the root of the blade or at the tip end portion, it will constitute the resistance that will impede smooth agitation, but as shown in FIG. 3, if the radial position of the maximum width portion is located within the range of 0.4–0.8 (40–80%), the discharge flow rate increases. If the radial position is located in the range within 0.5–0.7 (50–70%), the discharge flow rate further increases and at the radial position of 0.6, the discharge flow rate becomes the maximum.

However, in the case of an impeller having a maximum blade width less than 20% of the impeller diameter, the influence of the radial position of the maximum width portion on the discharge flow rate decreases and the discharge flow rate does not greatly vary whether the maximum width portion is located at the tip end portion or at the root.

(3) Pitch angle of the maximum width portion of the blade

Figure 4:
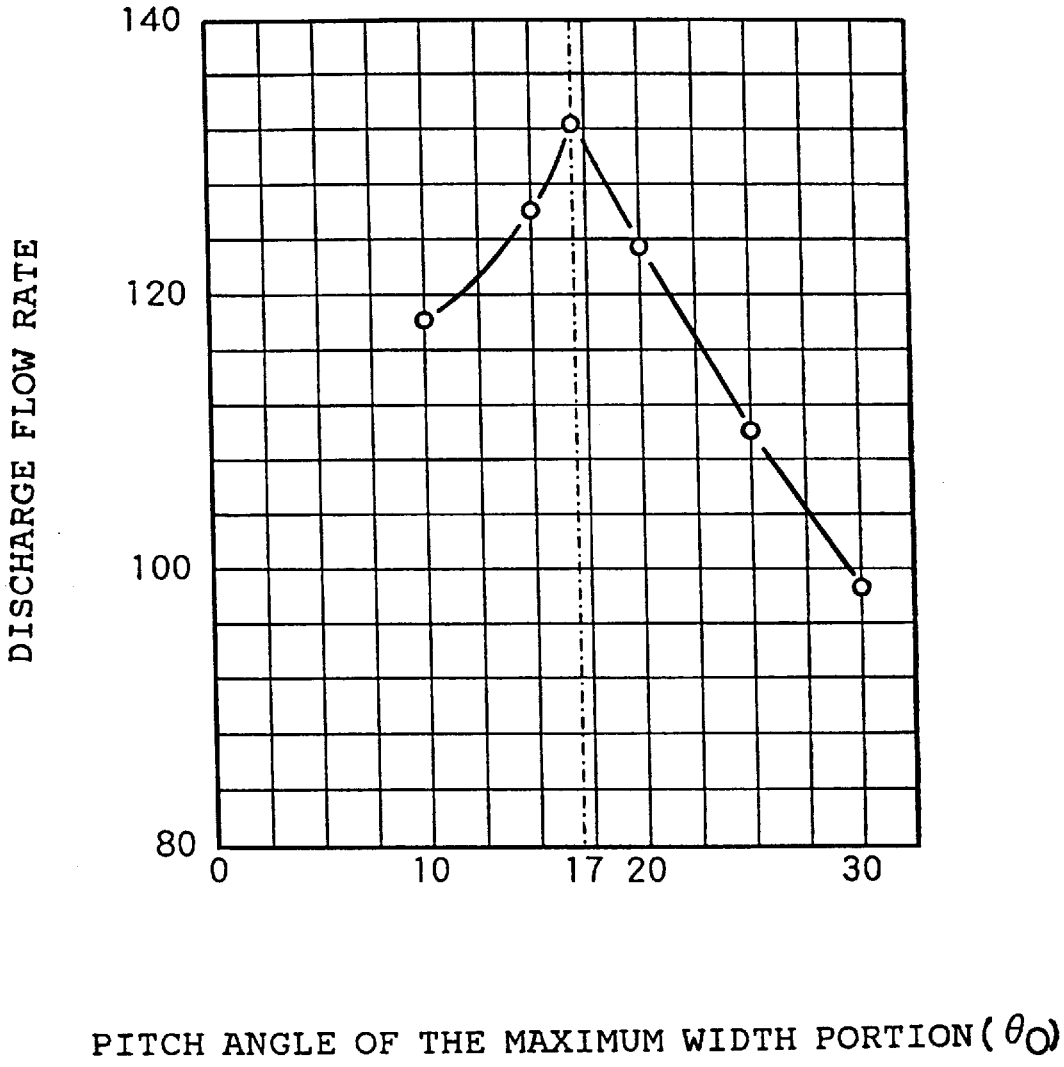
FIG. 4 shows the relationship between the discharge flow rate and the pitch angle when the maximum blade width is located at the radial position 0.7.

FIG. 4 shows the relationship between the pitch angle and the discharge flow rate when the maximum width portion of the blade is located at the 0.7 radial position. In this case, the maximum blade width is designated to 20% of the impeller diameter, the width at the tip end portion of the blade is about 50% of the maximum width, the pitch angle at the tip end portion of the blade is 0°–27°, the width at the root of the blade is about 50% of the maximum width, and the pitch angle at the root of the blade is 40°.

As shown in FIG. 4, when the pitch angle of the maximum width portion ($\theta_0$: see FIG. 8) is located within the range from 1220 to 22°, the discharge flow rate increases. When said pitch angle is located within the range from 15° to 20°, the discharge flow rate further increases.

If the maximum width of the blade is less than 20% of the impeller diameter, the pitch angle is also important, and since the large discharge flow rate is obtained by holding the pitch angle at the center of the blade in the radial direction to a proper range in order to reduce the fluid resistance, it is preferable to bring the pitch angle at the radial position 0.6 to the range from 12° to 22°.

(4) Width and pitch angle at the tip end portion of the blade

Figure 5:
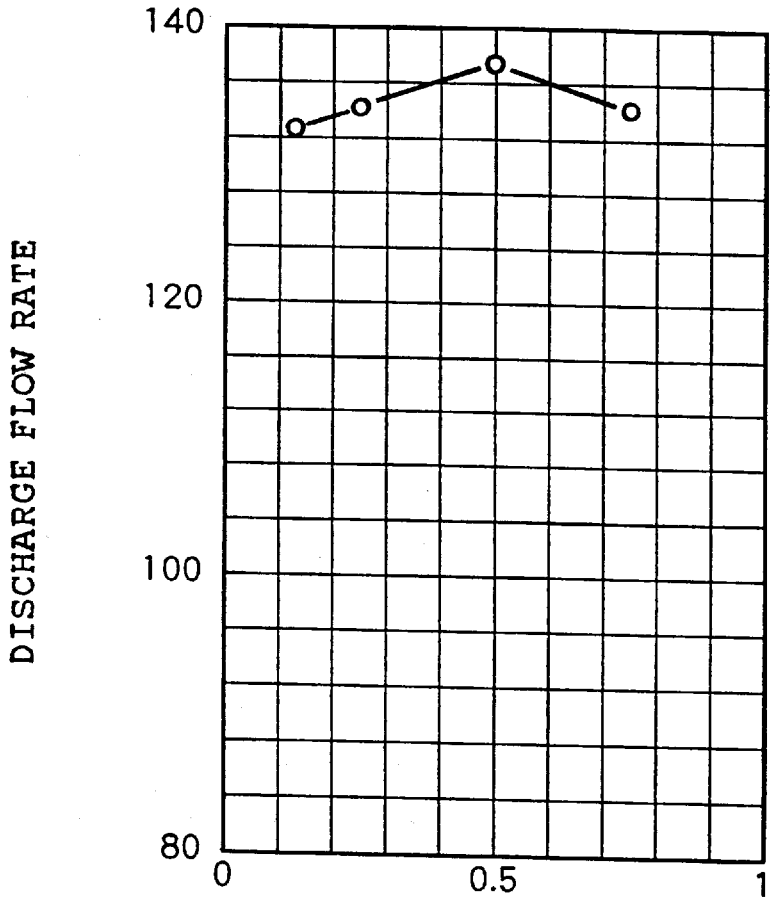
FIG. 5 shows the relationship between the discharge flow rate and the ratio of the width at the tip end portion of the blade to the maximum blade width.

FIG. 5 shows the relationship between the discharge flow rate and the ratio of the width at the tip end portion ($d_2$: see FIG. 8) to the maximum blade width ($W_0$). In this case, the maximum blade width is designated to 20% of the impeller diameter, the radial position of the maximum width portion is about 0.6, the pitch angle of the maximum width portion is 17°, the pitch angle at the tip end portion of the blade is about 11°, the width at the root of the blade is about 50% of the maximum width and the pitch angle at the root of the blade is 40°.

As shown in FIG. 5, when the width at the tip end portion of the blade is located in the range from 12 to 75% of the maximum width, the discharge flow rate scarcely varies and indicates a large value, but in particular, the discharge flow rate becomes the maximum when it is about 50% of the maximum width. In order to suppress the excessive energy consumption at the tip end portion of the blade, the pitch angle ($\theta_2$: see FIG. 9) at the tip end portion is desirable to be 5°–10° smaller than the pitch angle ($\theta_0$) of the maximum width portion.

Even when the maximum blade width is less than 20% of the impeller diameter, the width at the tip end portion of the blade is also important, and since the fluid resistance and energy consumption can be reduced by holding the width at the tip end portion with respect to the width at the center of the blade in the radial direction to a proper range, it is preferable to bring the width of the tip end portion to 12–75% of the width at the radial position 0.6. It is also preferable that the pitch angle of the tip end portion of this blade is made to be 5°–10° smaller from the pitch angle at the radial position 0.6 because of the above-mentioned same reason for suppressing the excessive energy consumption at the tip end portion of the blade.

(5) Width at the root of the blade

Figure 6:
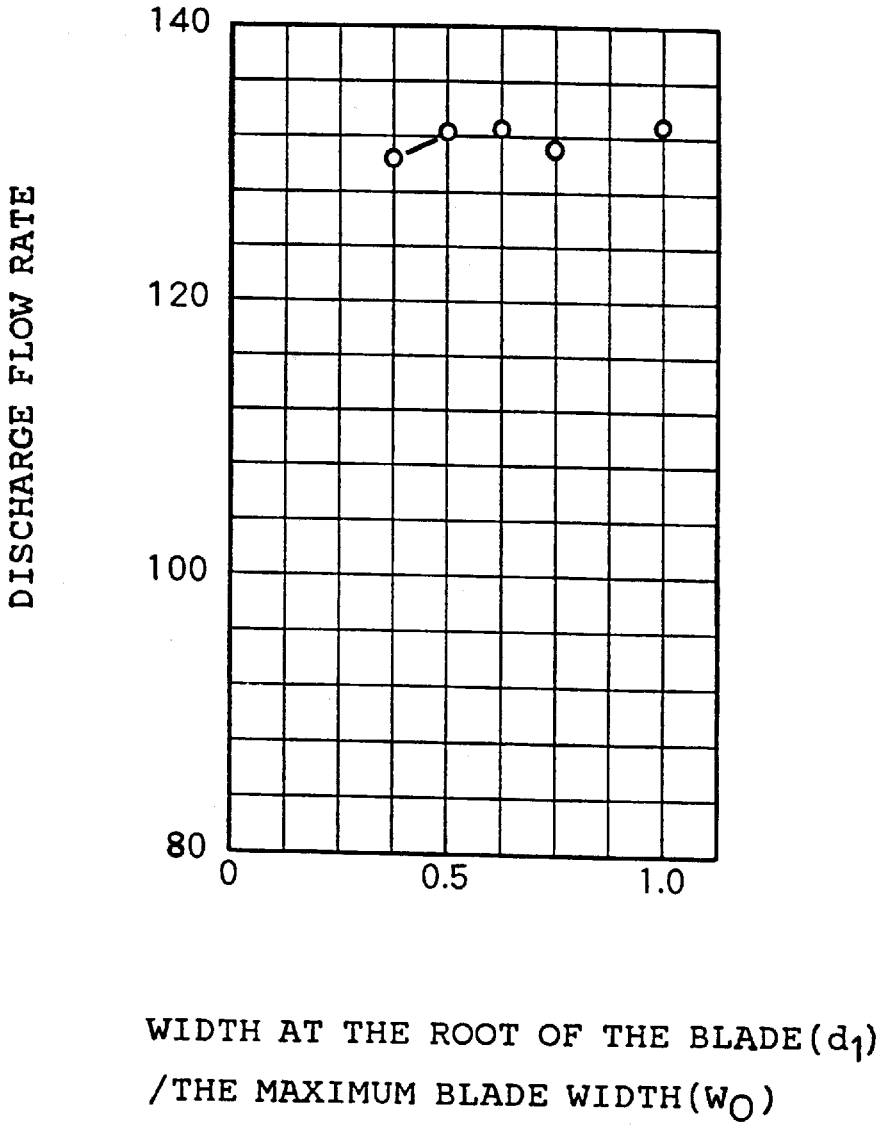
FIG. 6 shows the relationship between the discharge flow rate and the ratio of the blade width (width at the root of the blade) at the radial position 0.2 to the maximum blade width.

FIG. 6 shows the relationship between the discharge flow rate and the ratio of the width of the blade at the radial position 0.2 (width at the root of the blade) to the maximum blade width ($W_0$). In this case, the maximum blade width is designated to be 20% of the impeller diameter, the radial position of the maximum width portion is about 0.7, the pitch angle of the maximum width portion is 17°, the width at the tip end portion of the blade is about 50% of the maximum width, the pitch angle at the tip end portion of the blade is about 11°, and the pitch angle at the root of the blade is 40°.

As shown in FIG. 6, when the width of the blade is within the range from 40–100% of the maximum width, the discharge flow rate scarcely changes and exhibits a large value.

Even in the case of an impeller in which the maximum blade width is less than 20% of the impeller diameter, the width at the root of the blade is important, and it is preferable that the width at the root of the blade should be 40% or more of the width at the radial position 0.6 in order to obtain smooth discharge flow from the center portion in the radial direction of the blade to the root.

(6) Pitch angle at the root of the blade

Figure 7:
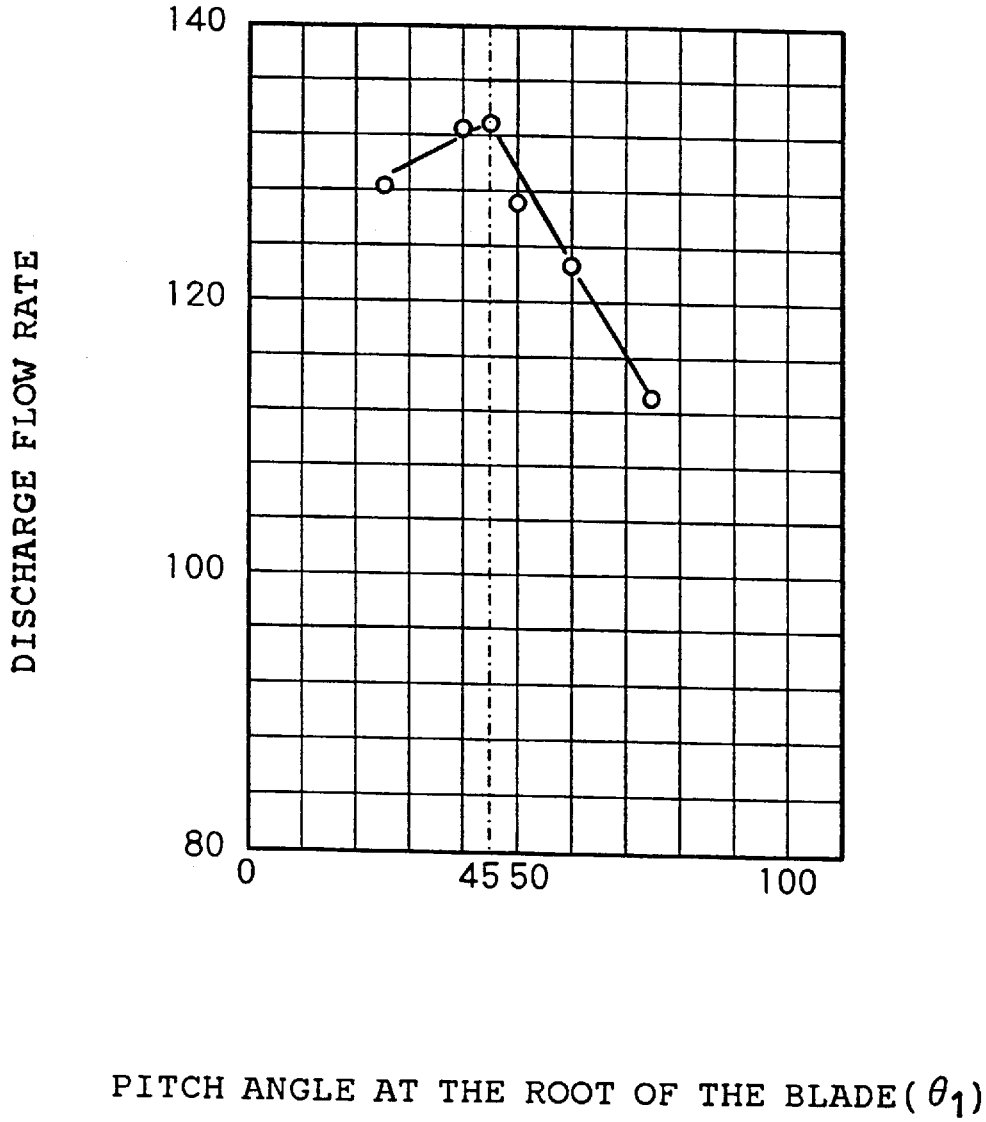
FIG. 7 shows the relationship between the discharge flow rate and the pitch angle of the blade at the radial position 0.2 (pitch angle at the root of the blade)
Figure 9A:
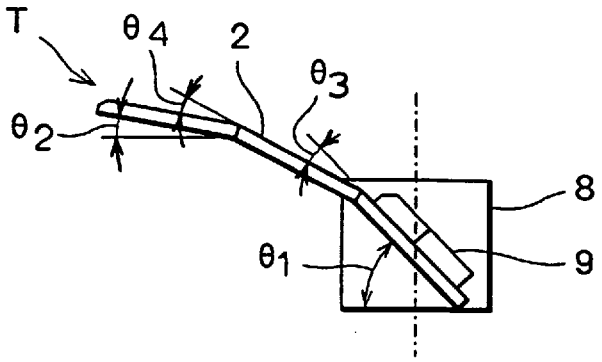
FIG. 9 (*a*) shows an enlarged side view of the blade of the axial-flow impeller of FIG. 8 and FIG. 9 (*b*) shows an enlarged view of section T of FIG. 9 (*a*)
Figure 9B:
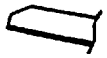

FIG. 7 shows the relationship between the discharge flow rate and the pitch angle at the radial position 0.2 (pitch angle $\theta_1$ at the root of the blade: see FIG. 9). In this case, the maximum blade width is designated to be 20% of the impeller diameter, the radial position of the maximum width portion is 0.7, the pitch angle of the maximum width portion is 17°, the width at the tip end portion of the blade is about 60% of the maximum width, the pitch angle at the tip end portion of the blade is 11°, and the width at the root of the blade is about 50% of the maximum width.

As shown in FIG. 7, when the pitch angle at the root of the blade exceeds 50°, the discharge flow rate decreases, and when said pitch angle is within the range from 25–50°, the discharge flow rate increases, and the discharge flow rate becomes a maximum when said pitch angle is at 40°–45°. Even in the case of an impeller in which the maximum width of the blade is less than 20% of the impeller diameter, the pitch angle at the root of the blade is important, and when the pitch angle becomes excessively large, the discharge flow rate decreases, and therefore, it is preferable to hold the pitch angle to the range from 25° to 50°.

(7) Surfaces constituting the blade

The surfaces may be cylindrical surfaces, conical surfaces, or planes, or those bent at one to two places, and in addition, curved surfaces with twist added to the plane, or combinations of all of these.

(8) Thickness of the blade

The sheet thickness shall be uniform through the full length of the blade and is acceptable if it is thick enough to secure the required mechanical strength. When the sheet thickness exceeds 5% of the maximum width, it is desirable to chamfer the edge on the upstream side of two edges on the leading side in the rotating direction of the blade from the maximum width position to the tip end portion (see FIG. 9 (*a*) and FIG. 9 (*b*), the enlarged view of section T).

(9) Number of blades and mounting method

It is preferable to use a plurality of blades and mount them to be rotationally symmetrical. When the bisector of the blade width is designated to the centerline, basically, the blades shall be mounted with this centerline identical to the radial direction, but when the blades are constructed with cylindrical surfaces or conical surfaces, the blade centerline may be advanced in the rotating direction from the root to the maximum width position.

(10) Summary

Based on the above investigation results, it has been found that a compact and economical axial-flow impeller with satisfactory discharge efficiency which can achieve the object of the present invention should have the following mixing impeller characteristics.

(1) When the maximum blade width is less than 20% of the impeller diameter:

(a) The pitch angle at the radial position 0.6 is 12°–22°;

(b) The width at the tip end portion of the blade is 12–75% of the width at the radial position 0.6 and the pitch angle at the tip end portion of the blade is 5°–10° smaller than the pitch angle at the radial position 0.6; and (c) The width at the root of the blade is 40% or more of the width at the radial position 0.6 and at the same time the pitch angle at the root of the blade is 25–50°.

(2) When the maximum blade width is 20% or more of the impeller diameter:

(a) The radial position of the maximum width portion is 0.4–0.8 and at the same time the pitch angle of the maximum width portion is 12°–22°;

(b) The width at the tip end portion of the blade is 12–75% of the maximum width and the pitch angle at the tip end portion of the blade is 5°–10° smaller than the pitch angle of the maximum width portion; and (c) The width at the root of the blade is 40–100% of the maximum width and at the same time the pitch angle at the root of the blade is 25°–50°.

That is, in accordance with this invention, an axial-flow impeller characterized by blades comprising the following elements (a) to (d) is designated the first embodiment of the invention.

(a) The maximum width of the blade is less than 20% of the impeller diameter;

(b) The pitch angle at the radial portion 0.6 is 12°–22°;

(c) The width at the tip end portion of the blade is 12–75% of the width at the radial position 0.6 and the pitch angle at the tip end portion of the blade is 5°–10° smaller than the pitch angle at the radial position 0.6; and (d) The width at the root of the blade is 40% or more of the width at the radial position 0.6 and the pitch angle at the root of the blade is 25°–50°.

An axial-flow impeller characterized by the blades comprising the following elements (a) to (d) is designated the second embodiment of the invention.

(a) The maximum width of the blade is 20% or more of the impeller diameter;

(b) The radial position of the maximum width portion of the blade is 0.4–0.8 and the pitch angle of the maximum width portion is 12°–22°;

(c) The width at the tip end portion of the blade is 12–75% of the maximum width and the pitch angle at the tip end portion of the blade is 5°–10° smaller than the pitch angle at the maximum width portion; and (d) The width at the root of the blade is 40–100% of the maximum width and the pitch angle at the root of the blade is 25°–50°.

Therefore the axial-flow impeller according to this invention is divided into two types of impellers in terms of the maximum width of the blade which has a significant effect on the discharge flow rate: An impeller of slim shape in which the maximum blade width is less than 20% of the impeller diameter; and an impeller in which the maximum blade width is 20% or more of the impeller diameter, and the width of each portion of the blade and the pitch angle are restricted in such a manner that the maximum discharge flow rate is obtained in each case, and a large discharge flow rate can be secured while the fluid resistance and energy consumption are reduced.

In the agitating operation, the liquid mixing speed is nearly proportional to the liquid circulating speed, that is, the discharge flow rate. Consequently, the axial-flow impeller according to this invention with excellent discharge efficiency (large discharge flow rate) enables the mixing of good efficiency.

In a certain agitating operation, not only the discharge flow rate but also the radial momentum which the impeller provides to the liquid, that is, the product of the discharge flow rate by the discharge flow velocity, become important. For example, in order to float up solid particles settled in the tank bottom, the flow velocity of the liquid for moving the particles and the flow rate corresponding to the area of the tank bottom are necessary. The product of the axial flow rate and flow velocity is proportional to the square of the discharge flow rate and inversely proportional to the rotating area of the impeller in the case of the axial-flow impeller. Consequently, the axial-flow impeller according to this invention with excellent discharge efficiency also provides excellent efficiency for generating the momentum of the liquid in the axial direction, and can float solid particles at high efficiency.

Referring now to the drawings, embodiments of this invention will be described in detail hereinafter.

FIG. 8 is a plan view showing an axial-flow impeller 1 of the first embodiment, and FIG. 9 (*a*) shows an enlarged side view of the blade 2. In this embodiment, the maximum width $W_0$ of the blade 2 is 20% of the impeller diameter D, the radial position of the maximum width portion 3 is 0.6, the pitch angle $\theta_0$ of the maximum width portion 3 is 17°, the width $d_2$ at the tip end portion 4 of the blade is 10% of the impeller diameter D (50% of the maximum width) and the pitch angle $\theta_2$ at the tip end portion 4 of the blade is 11°, the width of the blade at the radial position 0.2 is 10% of the impeller diameter D (50% of the maximum width) and the pitch angle $\theta_1$ at that position is 40°, and the blade is formed by bending a flat plate in thickness of 1% of the impeller diameter D (5% of the maximum width) at two places, with the two folds 5, 6 brought in parallel, and both bending angles $\theta_3$ and $\theta_4$ are 14.5°. In this embodiment, the centerline 7 of the blade leads in the rotating direction from the root to the maximum width position. A bracket 9 was used to fix the impeller to the fixture (hereinafter called the "boss") 8 and supplement the mechanical strength of the blade 2.

Figure 10:
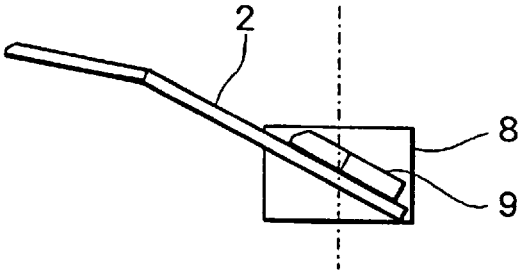
FIG. 10 shows an enlarged side view showing another example of the blade of the axial-flow impeller of FIG. 8.
Figure 11:
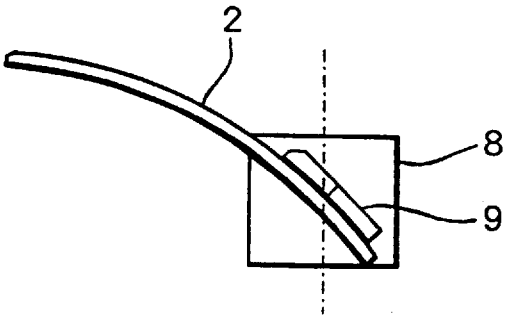
FIG. 11 shows an enlarged side view showing still another example of the blade of the axial-flow impeller of FIG. 8.
Figure 12:
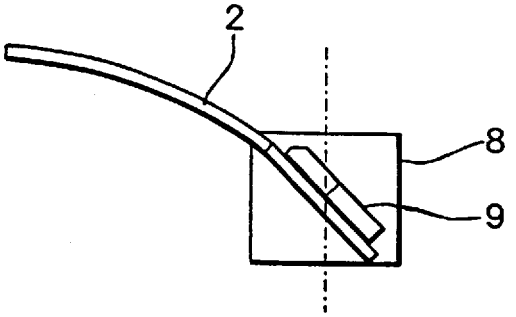
FIG. 12 shows an enlarged side view showing even another example of the blade of the axial-flow impeller of FIG. 8.

As an applied example of the first embodiment, a shape of blade 2 with the bend at the root removed from that of FIG. 9 as shown in FIG. 10, or a shape of blade 2 comprising cylindrical surfaces as shown in FIG. 11, or further, a shape of blade 2 comprising cylindrical surfaces and planes as shown in FIG. 12 may be employed. Of these, the blade shape as shown in FIG. 11 and 12 can achieve the discharge efficiency equivalent to that of the first embodiment. The blade shape as shown in FIG. 10 slightly lowers the discharge efficiency because the pitch angle at the root of the blade is slightly smaller than the optimum value.

FIG. 13 (*a*) shows a plan view of the axial-flow impeller according to the second embodiment and FIG. 14 shows the enlarged side view of the blade. The maximum width of the blade 10 according to this embodiment, the radial position and the pitch angle of the maximum width portion, the width at the tip end portion of the blade, and the width and the pitch angle of the blade at the radial position 0.2 are the same as those of the first embodiment, except the pitch angle at the tip end portion of the blade is 9.5°. In this embodiment, the blade is composed of the surfaces formed by bending the plane along the two straight lines L, L, and is free of camber, and the centerline 11 of the blade correctly agrees with the radial direction from the boss 8.

Figure 15:
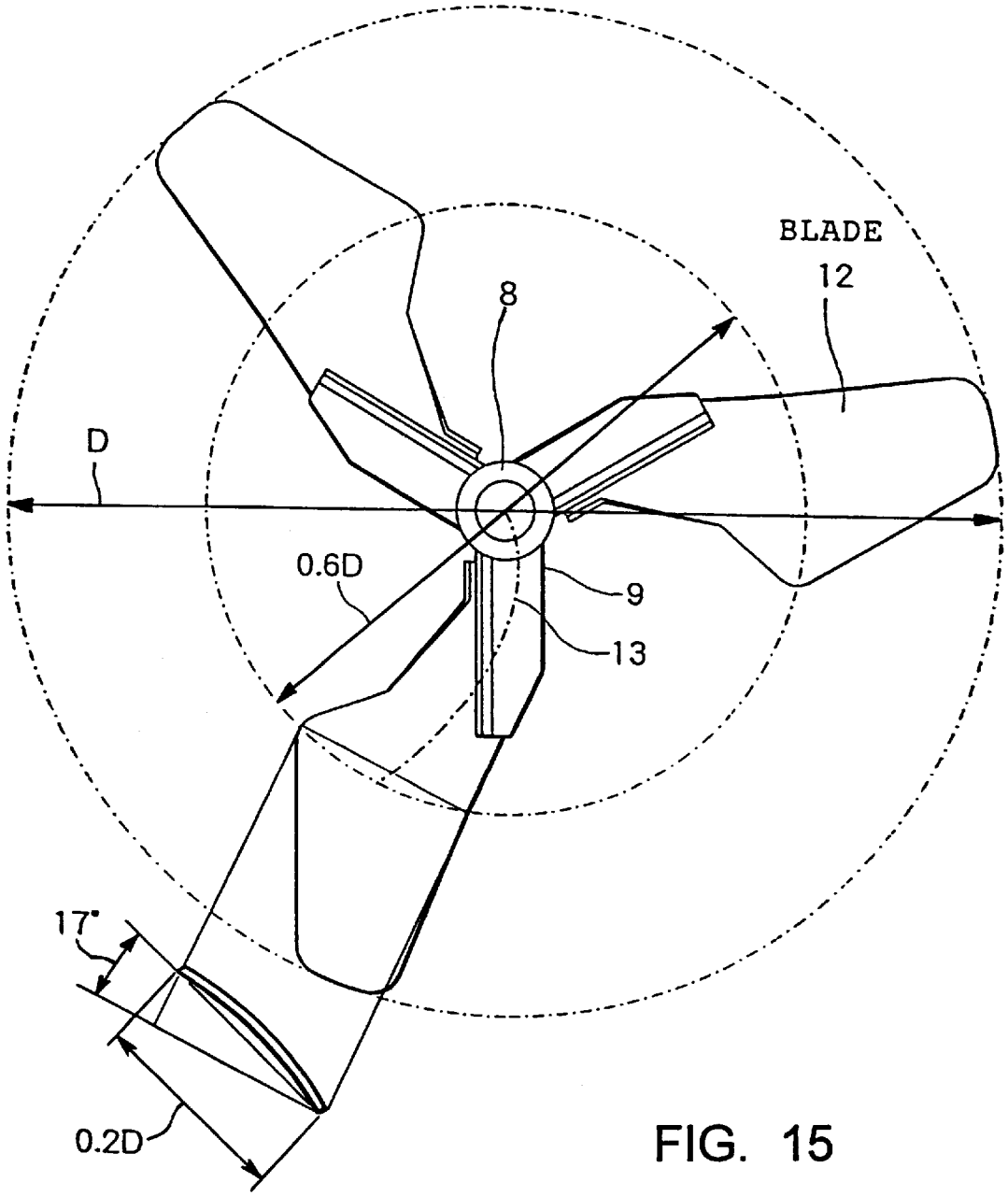
FIG. 15 shows a plan view of an axial-flow impeller of a third embodiment.
Figure 16:
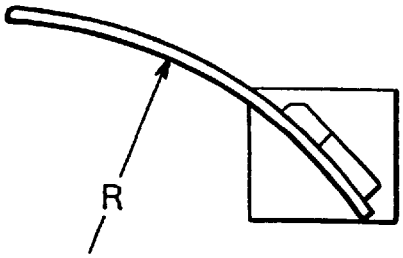
FIG. 16 shows an enlarged side view showing the blade of the axial-flow impeller of FIG. 15.

FIG. 15 shows a plan view of the axial-flow impeller according to the third embodiment, and FIG. 16 shows an enlarged side view of the blade. The maximum width of the blade 12 of this embodiment, the radial position and pitch angle of the maximum width portion, the width and pitch angle at the tip end portion of the blade, and the width and the pitch angle of the blade at the radial position 0.2 are the same as those of the first embodiment, and with respect to the surfaces composing the blade and thickness, the surfaces are cylindrical surfaces with a curvature radius R of 36% of the impeller diameter D and the thickness is 1% of the impeller diameter (5% of the maximum width). In this way, camber is generated in the circumferential direction because cylindrical blades are used, but in this way, it is possible to substitute the twisting effects of the blades with the cylindrical surfaces which are easy to fabricate, and it is economical. In this embodiment, the blade centerline 13 advances in the radial direction from the root to the maximum width position. A bracket 9 is used to fix the impeller to the boss 8 and supplement the mechanical strength of the blade 12.

Figure 17:
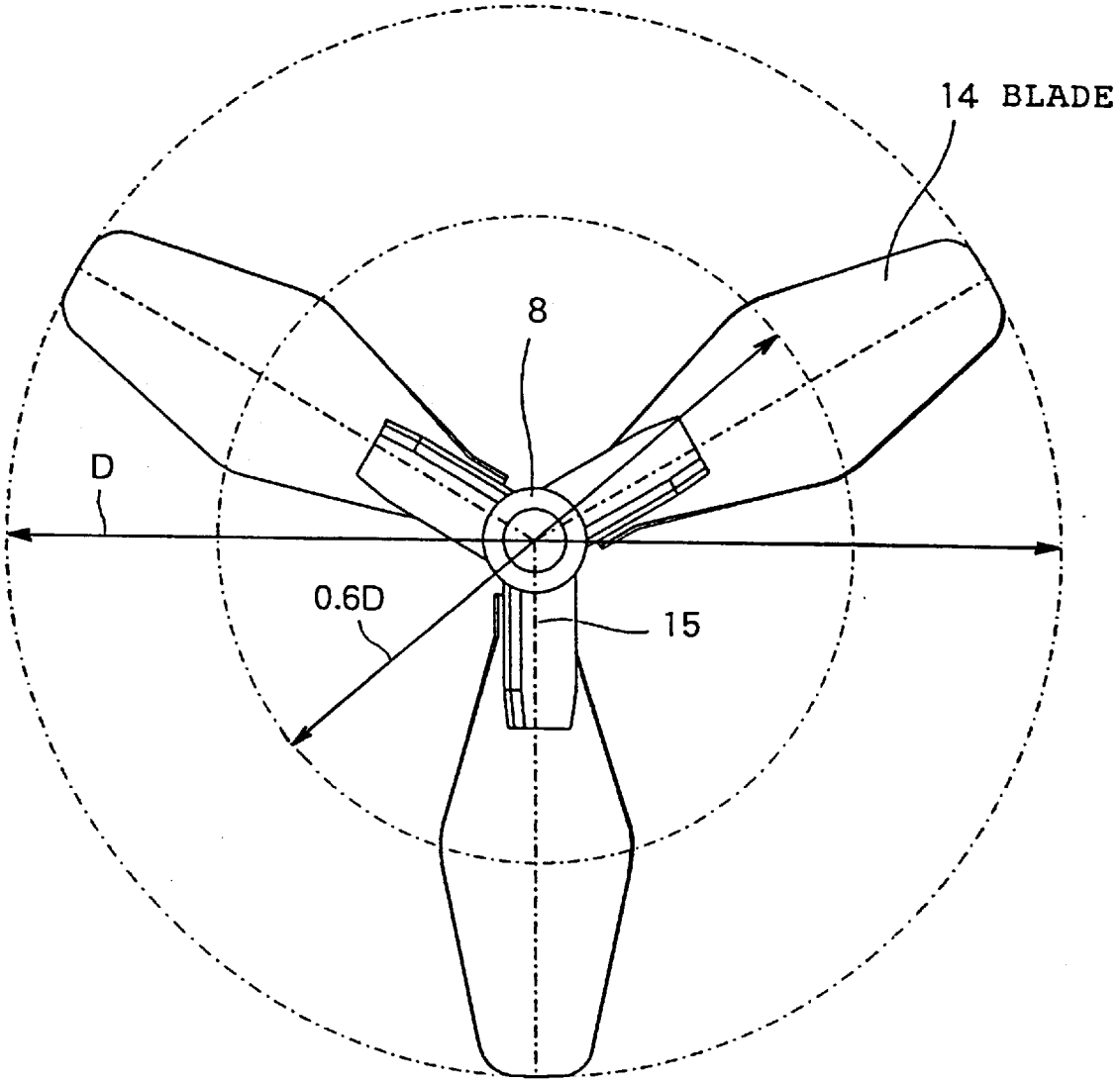
FIG. 17 shows a plan view of an axial-flow impeller of a fourth embodiment.
Figure 18:
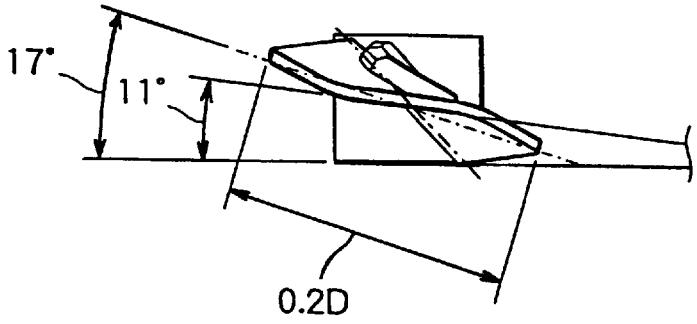
FIG. 18 shows an enlarged side view showing the blade of the axial-flow impeller of FIG. 17.
Figure 19:
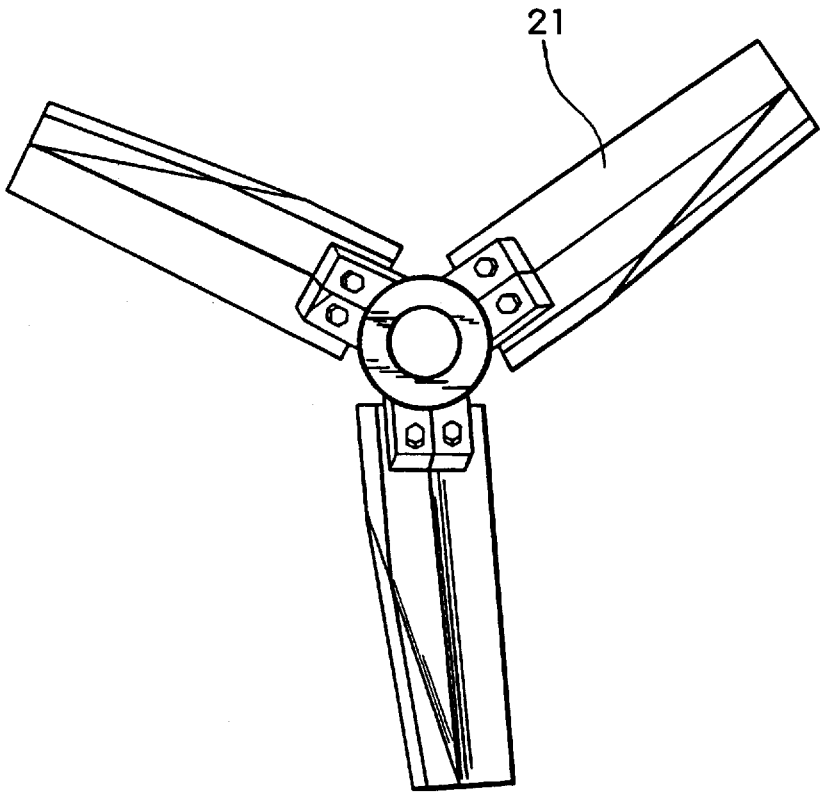
FIG. 19 PRIOR ART
FIG. 19 shows a plan view of a conventional impeller A.
Figure 20:
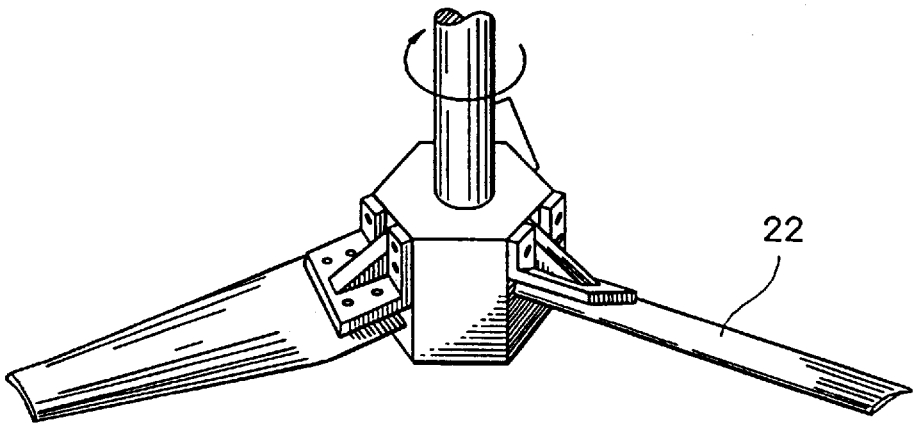
FIG. 20 PRIOR ART
FIG. 20 shows a perspective view of a conventional impeller B.
Figure 21:
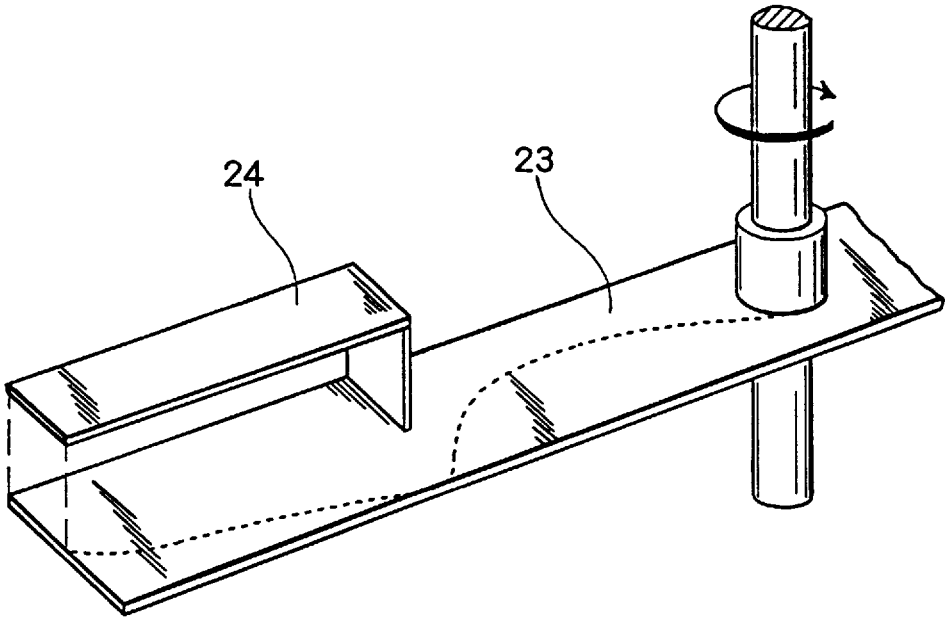
FIG. 21 PRIOR ART
FIG. 21 shows a perspective view of a conventional impeller C.

FIG. 17 shows a plan view of the axial-flow impeller according to the fourth embodiment and FIG. 18 shows an enlarged side view of the blade. The maximum width of the blade 14 of this embodiment, the radial position and pitch angle of the maximum width portion, the width and the pitch angle at the tip end portion of the blade, and the width and the pitch angle of the blade at the radial position 0.2 are the same as those of the third embodiment. In this embodiment, the blade is composed of a curved surface with a simple twist added to a plane, and is free from camber, and the centerline 15 of the blade correctly agrees with the radial direction from the boss 8.

Figure 1:
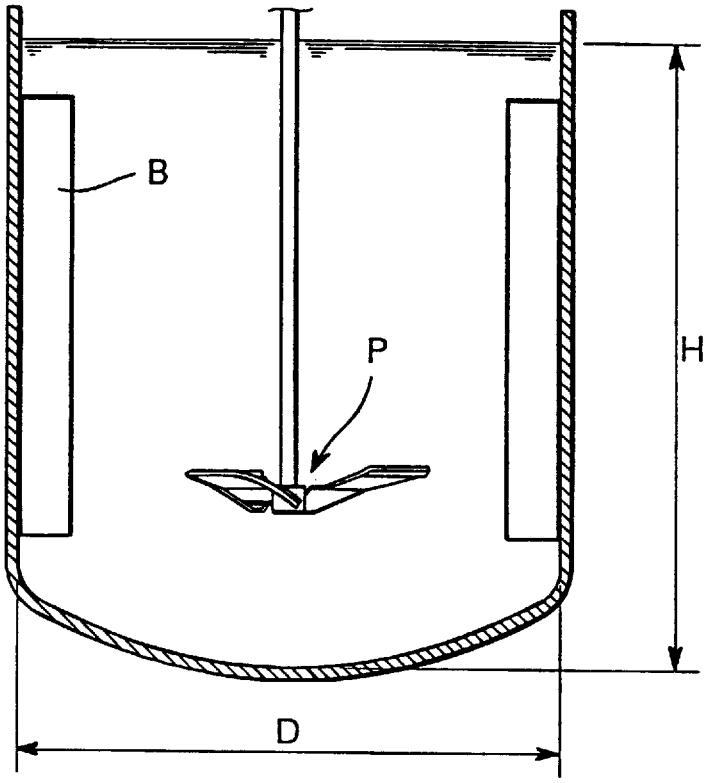
FIG. 1 shows a cross-sectional view of an agitator tank.

In order to compare the discharge flow rate of the axial-flow impeller of this invention with that of the conventional axial-flow impeller, in the manner similar to the above, using the agitating tank shown in FIG. 1, an impeller was mounted to the same position, and the discharge flow rate was measured at the same water volume (58.6 L), same rotating speed (300 rpm), same torque (0.43 Nm), and same energy consumption (0.013 kW). The measuring results of the discharge flow rate by the above-mentioned measuring method are described as follows.

(1) The discharge flow rate of the axial-flow impeller according to the first embodiment was 24% greater than that of the propeller. When the discharge flow rate of the axial-flow impeller according to the first embodiment was brought to the same level as that of the propeller, the rotating speed was able to be lowered by 19%, the torque reduced by 35%, and the energy consumption reduced by 48%.

(2) The discharge flow rate of the axial-flow impeller according to the first embodiment was 29% greater than that of the conventional impeller A. When the discharge flow rate of the axial-flow impeller according to the first embodiment was brought to the same level as that of the conventional impeller A, the rotating speed was able to be lowered by 22%, the torque reduced by 40%, and the energy consumption reduced by 53%.

(3) The discharge flow rate of the axial-flow impeller according to the second embodiment was 17% greater than that of the propeller. When the discharge flow rate of the axial-flow impeller according to the second embodiment was brought to the same level as that of the propeller, the rotating speed was able to be lowered by 15%, the torque reduced by 27%, and the energy consumption reduced by 38%.

(4) The discharge flow rate of the axial-flow impeller according to the third embodiment was 35% greater than that of the conventional impeller B. When the discharge flow rate of the axial-flow impeller according to the third embodiment was brought to the same level as that of the conventional impeller B, the rotating speed was able to be lowered by 26%, the torque reduced by 45%, and the energy consumption reduced by 59%.

(5) The discharge flow rate of the axial-flow impeller according to the third embodiment was 63% greater than that of the conventional impeller D. When the discharge flow rate of the axial-flow impeller according to the third embodiment was brought to the same level as that of the conventional impeller D, the rotating speed was able to be lowered by 39%, the torque reduced by 62%, and the energy consumption reduced by 77%.

Next the mixing performance of the axial-flow impeller of the first embodiment according to this invention was compared with that of the conventional axial-flow impeller. That is, in the similar manner as described above, using the agitating tank shown in FIG. 1, the impeller was mounted to the same position, and after coloring the water inside the agitating tank with an iodine starch at the same water volume (50 L), a suitable amount of soda thiosulfate was added, and the number of rotations, energy consumption, and torque required to eliminate water color for 10 seconds were measured, the results of which are shown in Table 1 below.

Glass beads of 150 $\mu$m in diameter were added 10% by weight to the agitating tank, and the rotating speed, energy consumption, and torque required for floating glass beads uniformly in the agitating tank were measured, the results of which are shown in Table 2 below. "Floating glass beads uniformly" means the condition in which the content of glass beads in suitable amount of water collected from the vicinity of the water surface is about 10% by weight.

TABLE 1

| | | Rotating Speed (rpm) | Energy consumption per unit volume ($W/m^3$) | Torque per unit volume ($Nm/m^3$) |
|---|---|---|---|---|
| Axial-flow impeller of first embodiment | | 122 | 8.1 | 0.63 |
| Comparison examples | Conventional impeller B | 150 | 15.5 | 0.99 |
| | 45°-pitched paddle impeller | 192 | 37.1 | 1.84 |

TABLE 2

| | | Rotating Speed (rpm) | Energy consumption per unit volume ($W/m^3$) | Torque per unit volume ($Nm/m^3$) |
|---|---|---|---|---|
| Axial-flow impeller of first embodiment | | 295 | 124 | 4.0 |
| Comparison examples | Propeller impeller with 1 pitch | 370 | 273 | 7.0 |
| | 45°-pitched paddle impeller | 510 | 765 | 14.3 |

As is clear from Table 1 and Table 2, the mixing performance of the axial-flow impeller according to this invention is remarkably outstanding as compared to conventional impellers.

Because the present invention is composed as described above, the effects are described as follows.

(1) Because attention was placed on the maximum width of the blade which has the greatest effect on the discharge flow rate and the impeller was divided into two types: An impeller with the blade with slim shape; and An impeller with the blade slightly wider;—and wherein the width and pitch angle of each portion of the blade were restricted to a proper range in relevant cases, the impeller is able to provide extremely outstanding discharge efficiency and thorough mixing can be expected even when it is applied to streams with violent turbulence such as the flow in the agitating tank.

(2) Because the impeller can be constituted with the blade surface of simple shape such as a plane bent at one or two places, the impeller can not only be fabricated at low cost but also the equipment cost and operating cost of the agitator can be reduced.

(3) Consequently, the impellers of optional sizes from beaker-scale to large-size can be fabricated at high precision and economically without using dies.

What is claimed is:

1. An axial-flow impeller having a plurality of blades mounted on a shaft rotatably for mixing liquids, each of said blades including (1) a leading edge and a trailing edge with respect to the direction of rotation of said blades, (2) a radial position defined by the position in the radial direction when the impeller shaft center is designated as 0 and the blade tip end is designated as 1, (3) a blade width defined by the linear distance between said leading edge and said trailing edge at the same radial position from said shaft, (4) a pitch angle defined by the angle formed between the straight line used to define said blade width and a plane perpendicular to said shaft, (5) a blade root defined at a mounting joint between said blade and said shaft, and (6) a blade tip end portion at the radial end of said blade, each of said blades comprising:

(a) the maximum blade width is less than 20% of the impeller diameter;

(b) the pitch angle at the radial position 0.6 is 15°–20°;

(c) the width at the blade tip end portion is 25–75% of the blade width at the radial position 0.6, and at the same time the pitch angle at the blade tip end portion is 5°–10° smaller than the pitch angle at the radial position 0.6; and (d) the blade width at the blade root is 40% or more of the blade width at the radial position 0.6, and at the same time the pitch angle at the blade root is 40°–45°.

2. An axial-flow impeller having a plurality of blades mounted on a shaft rotatably for mixing liquids, each of said blades including (1) a leading edge and a trailing edge with respect to the direction of rotation of said blades, (2) a radial position defined by the position in the radial direction when the impeller shaft center is designated as 0 and the blade tip end is designated as 1, (3) a blade width defined by the linear distance between said leading edge and said trailing edge at the same radial position from said shaft, (4) a pitch angle defined by the angle formed between the straight line used to define said blade width and a plane perpendicular to said shaft, (5) a blade root defined at a mounting joint between said blade and said shaft, and (6) a blade tip end portion at the radial end of said blade, each of said blades comprising:

(a) the maximum blade width is 20% or more of the impeller diameter;

(b) the radial position at the maximum blade width portion is 0.4–0.8, and at the same time the pitch angle at the maximum blade width portion is 15°–20°;

(c) the width at the blade tip end portion is 25–75% of the maximum blade width, and at the same time the pitch angle at the blade tip end portion is 5°–10° smaller than the pitch angle at the maximum blade width portion; and (d) the blade width at the blade root is 40% or more of the maximum blade width, and at the same time the pitch angle at the blade root is 40°–45°.

* * * * *